US007362307B2

(12) United States Patent
Wu et al.

(10) Patent No.: US 7,362,307 B2
(45) Date of Patent: Apr. 22, 2008

(54) JOYSTICK CONNECTABLE TO THE OPERATING MEMBER OF AN EXERCISER OR GAME MACHINE

(75) Inventors: Hong-Sheng Wu, Tuku Township, Yunlin County (TW); Jhong-Jie Chen, Tai-Chung (TW); Wei-Long Chen, Wuci Township, Tai-Chung County (TW)

(73) Assignee: Cycling & Health Tech Industry R & D Center, Taichung (TW)

( * ) Notice: Subject to any disclaimer, the term of this patent is extended or adjusted under 35 U.S.C. 154(b) by 447 days.

(21) Appl. No.: 11/098,680

(22) Filed: Apr. 4, 2005

(65) Prior Publication Data

US 2006/0221054 A1 Oct. 5, 2006

(51) Int. Cl.
*G09G 5/08* (2006.01)

(52) U.S. Cl. ..... 345/161

(58) Field of Classification Search ..... 345/156–184
See application file for complete search history.

(56) References Cited

U.S. PATENT DOCUMENTS 4,479,038 A * 10/1984 Marhold et al. ..... 200/6 A
4,587,510 A * 5/1986 Kim ..... 338/128
5,065,146 A * 11/1991 Garrett ..... 345/161
5,406,040 A * 4/1995 Johnson ..... 200/6 A
6,362,810 B1 * 3/2002 Matsuda ..... 345/161
2005/0195166 A1 * 9/2005 Cooper et al. ..... 345/161

* cited by examiner

*Primary Examiner*—Alexander Eisen
*Assistant Examiner*—Cory A Almeida
(74) *Attorney, Agent, or Firm*—Charles E. Baxley

(57) ABSTRACT

A joystick used in a motion apparatus, for example, an exerciser or game machine, is disclosed to include a base fixedly fastened to the body of the motion apparatus, a motion member fixedly fastened to the operating member of the motion apparatus for biasing with the operating member by the user, elastomeric members connected between the base and the motion member, and a control member coupled to the motion member and movable relative to the motion member to lock the motion member to the base or to adjust the maximum biasing angle allowable for the motion member and the operating member.

6 Claims, 7 Drawing Sheets

JOYSTICK CONNECTABLE TO THE OPERATING MEMBER OF AN EXERCISER OR GAME MACHINE

BACKGROUND OF THE INVENTION

1. Field of the Invention

The present invention relates to a joystick and more particularly, to such a joystick, which can be used in an exerciser or game machine and connected between the body and an operating member of the exerciser or game machine, and which can be locked and stopped from operation.

2. Description of the Related Art

Various exercising apparatus are known connectable to a multimedia computer so that the user can play a video game while exercising. These exercising apparatus make exercise attractive. Therefore, these exercising apparatus are widely invited.

A joystick is a member of an exercising apparatus connectable to a multimedia computer. A joystick for this purpose has a handle or lever connected to an operating member of the exercising apparatus, and a sensor provided on the inside and adapted to detect the direction and amount of movement of the handle or lever and to output a signal indicative of the direction and amount of movement of the handle or lever to the external multimedia computer for further processing for controlling the motion of a virtual actor in a virtual reactive software or video game. However, conventional joysticks for this purpose commonly have a complicated structure.

SUMMARY OF THE INVENTION

The present invention has been accomplished under the circumstances in view. It is therefore the main object of the present invention to provide a joystick, which is usable in an exerciser or game machine for outputting a signal indicative of the direction and mount of movement of an operating member of the exerciser or game machine operated by the user. It is another object of the present invention to provide a joystick, which can be locked and stopped from operation. It is still another object of the present invention to provide a joystick, which can be adjusted to change the maximum biasing angle allowable for the operating member.

To achieve these and other objects of the present invention, the joystick comprises joystick comprises a base fixedly fastened to the body of a motion apparatus, the base having a top; a plurality of elastomeric members installed in the top of the base and equiangularly spaced from one another, the elastomeric members each having a bottom side fastened to the top of the base and a top side; a motion member fixedly to the elastomeric members and supported on the top side of each the elastomeric member and fixedly connected to an operating member for synchronous motion with the operating member relative to the base; sensor means adapted to detect the direction and amount of movement of the motion member relative to the base and to output a signal indicative of the direction and amount of movement of the motion member; and a control member axially movably coupled to the motion member and turnable relative to the motion member to adjust the distance between the lowest edge of the control member and the top of the base so as to further control the range within which the motion member is biasable relative to the base.

DETAILED DESCRIPTION OF THE PREFERRED EMBODIMENT

Figure 1:
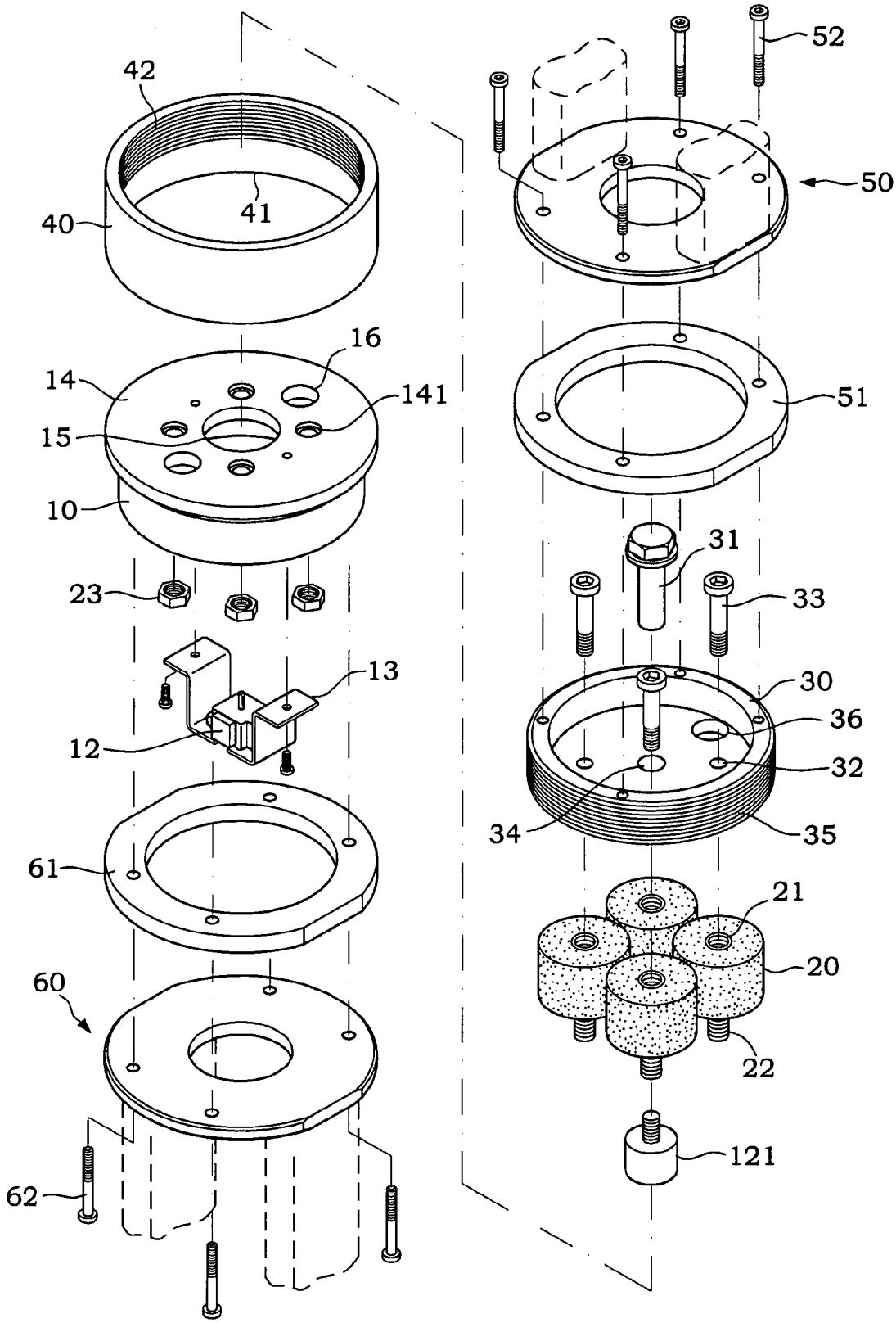
FIG. 1 is an exploded view of a joystick according to the present invention.
Figure 2:
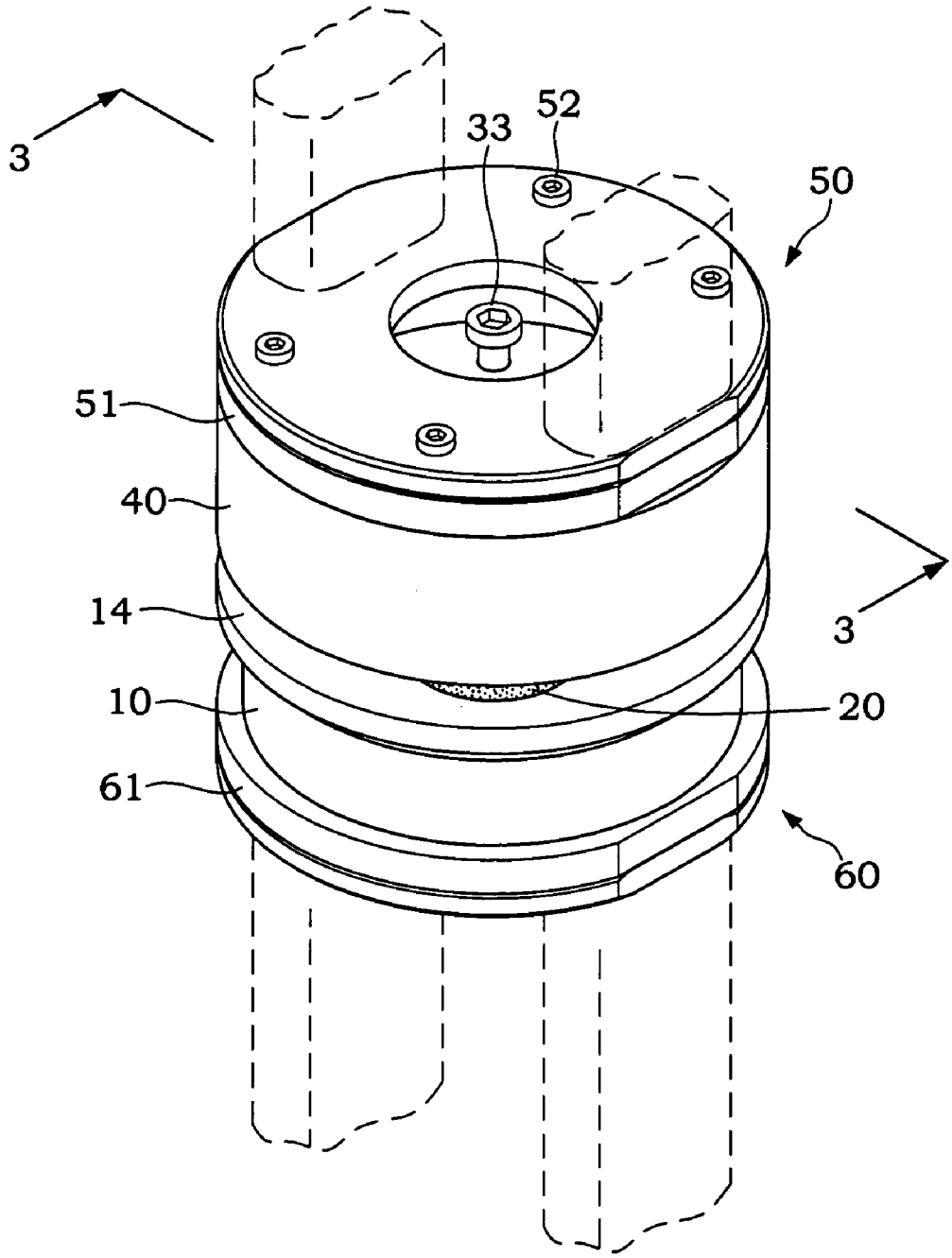
FIG. 2 is a perspective view of the present invention, showing the joystick adjusted to the maximum biasing angle position.
Figure 3:
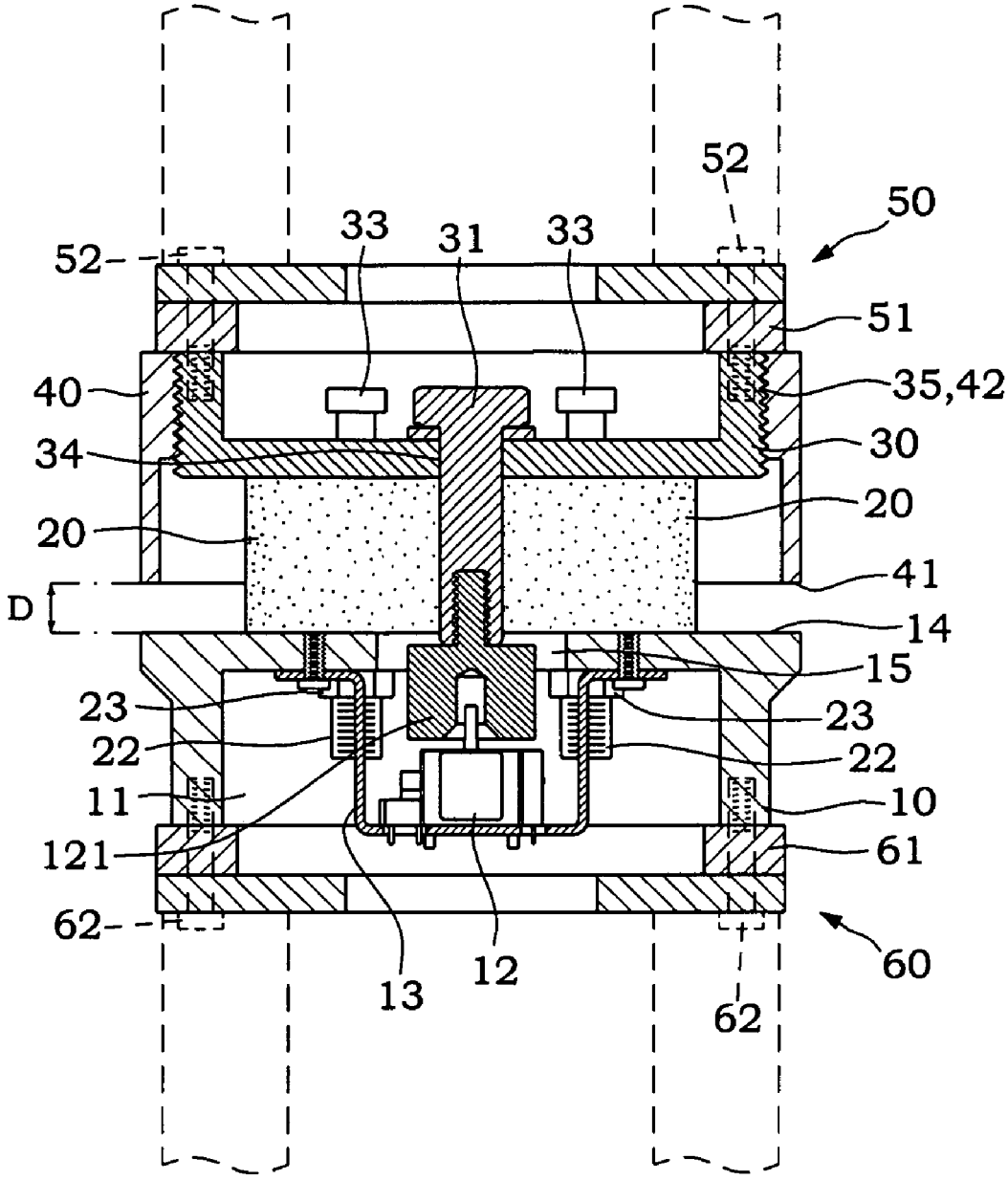
FIG. 3 is a sectional view taken along line 3-3 of FIG. 2.

Referring to FIGS. 1~3, a joystick in accordance with the present invention is shown comprising:

a connecting member 60 fixedly fastened to a motion apparatus (not shown), for example, an exerciser or game machine;

a hollow base 10 fastened to the connecting member 60 with screws 62, the hollow base 10 having a head 14, a center through hole 15 extending through the center of the head 14 and a plurality of mounting through holes 141 extending through the head 14 and equiangularly spaced around the center through hole 15;

a first packing member 61 coupled to the screws 62 and set in between the connecting member 60 and the base 10;

a plurality of cylindrical elastomeric members 20 made from rubber of hardness 45°±5°, tensile strength 270 kgs~350 kgs, and maximum amount of destructive deformation 80 mm~100 mm respectively supported on the top side of the head 14 of the base 10, cylindrical elastomeric member 20 each having a bottom screw rod 22 respectively inserted through the mounting through holes 141 of the base 20 and screwed up with a respective nut 23 and a top center screw hole 21;

a motion member 30 supported on the cylindrical elastomeric members 20, the motion member 30 having a center through hole 34, an outer thread 35 extending around the periphery thereof, and a plurality of mounting through holes 32 equiangularly spaced around the center through hole 34 and respectively fastened to the top screw holes 21 of the cylindrical elastomeric members 20 by screws 33;

an operating member 50 fixedly fastened to the top side of the motion member 30 with screws 52 for operation by the user to move the motion member 30 and the cylindrical elastomeric members 20;

a second packing member 51 coupled to the screws 33 and set in between the motion member 30 and the operating member 50;

a control member 40, the control member 40 having an inner thread 42 threaded onto the outer thread 35 of the motion member 30 and a bottom edge 41 corresponding to the top side of the head 14 of the base 10; and a sensor 12 adapted to detect the direction and amount of movement of the motion member 30 relative to the base 10 and to output a signal to the game machine main unit or computer (not shown) indicative of the direction and amount of movement of the motion member 30, the sensor 12 comprising a bracket 13 fixedly mounted in the inside space 11 (see FIG. 3) of the base 10, a connector 121 at the top, and a probe 31 downwardly inserted through the center through hole 34 of the motion member 30 and the center through hole 15 of the base 10 and connected to the connector 121 for trigging the sensor 12 subject to the motion of the motion member 30.

Further, the base 10 and the motion member 30 have wire holes 16 or 36 for the passing of electric wires.

Figure 4:
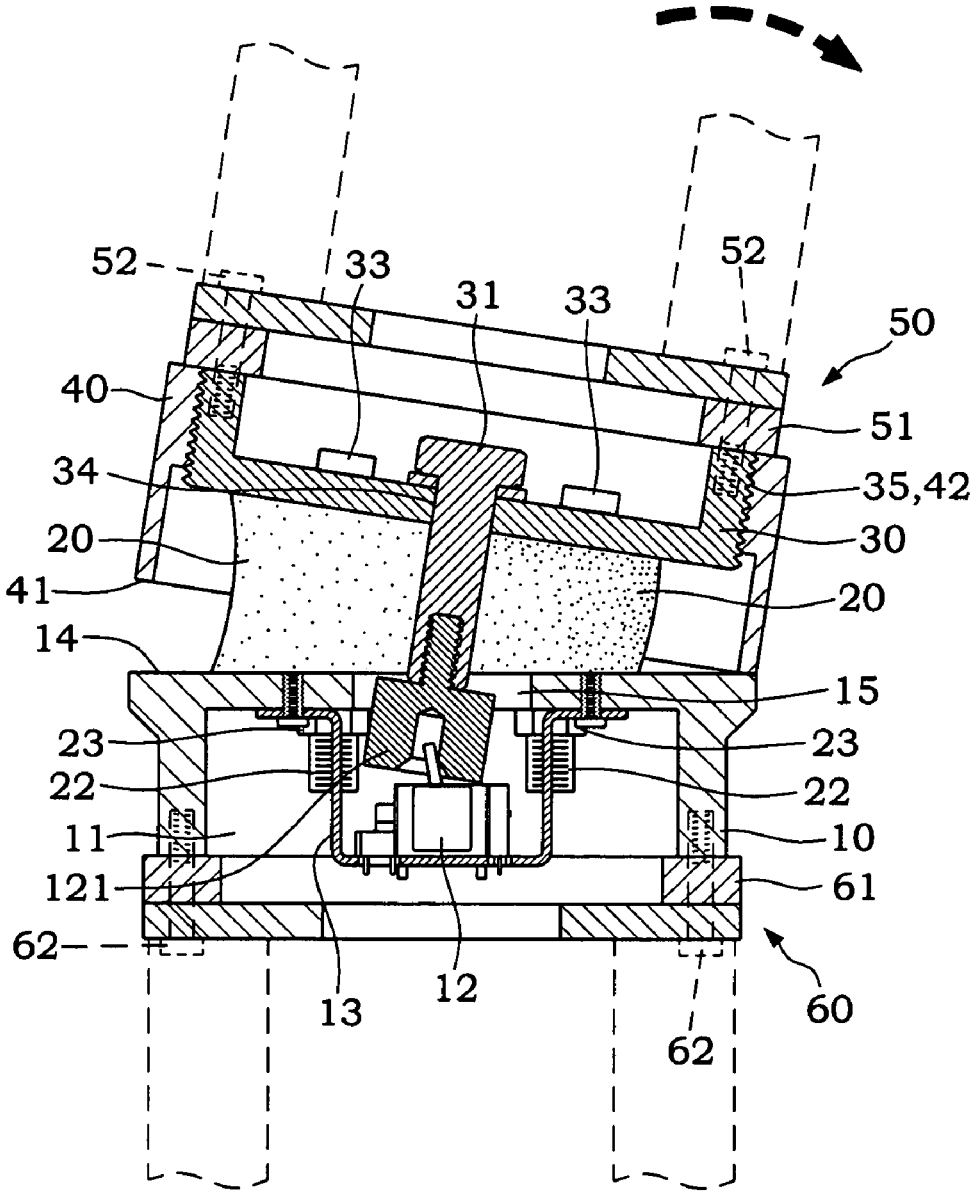
FIG. 4 is a schematic drawing corresponding to FIG. 3, showing the joystick tilted in one direction.

Referring to FIG. 4 and FIG. 3 again, when rotated the control member 40 relative to the motion member 30 to a position where the bottom edge 41 of the control member 40 is kept away from the top side of the head 14 of the base 10 at a distance D, the motion member 30 can be biased with the operating member 50 relative to the base 10. At this time, the user can operate the operating member 50 and move the operating member 50 to the desired direction. When moving the operating member 50, the motion member 30 is moved with the operating member 50 relative to the base 10, and the cylindrical elastomeric members 20 are elastically deformed, and at the same time the motion member 30 touches the probe 31, thereby causing the sensor 12 to output a signal indicative of the direction and amount of movement of the motion member 30 to the game machine main unit or computer for further processing to control the motion of a virtual actor in a virtual reactive software/game. When the external force disappeared, the cylindrical elastomeric members 20 immediately return to their former shape, holding the motion member 30 in a still position.

Figure 5:
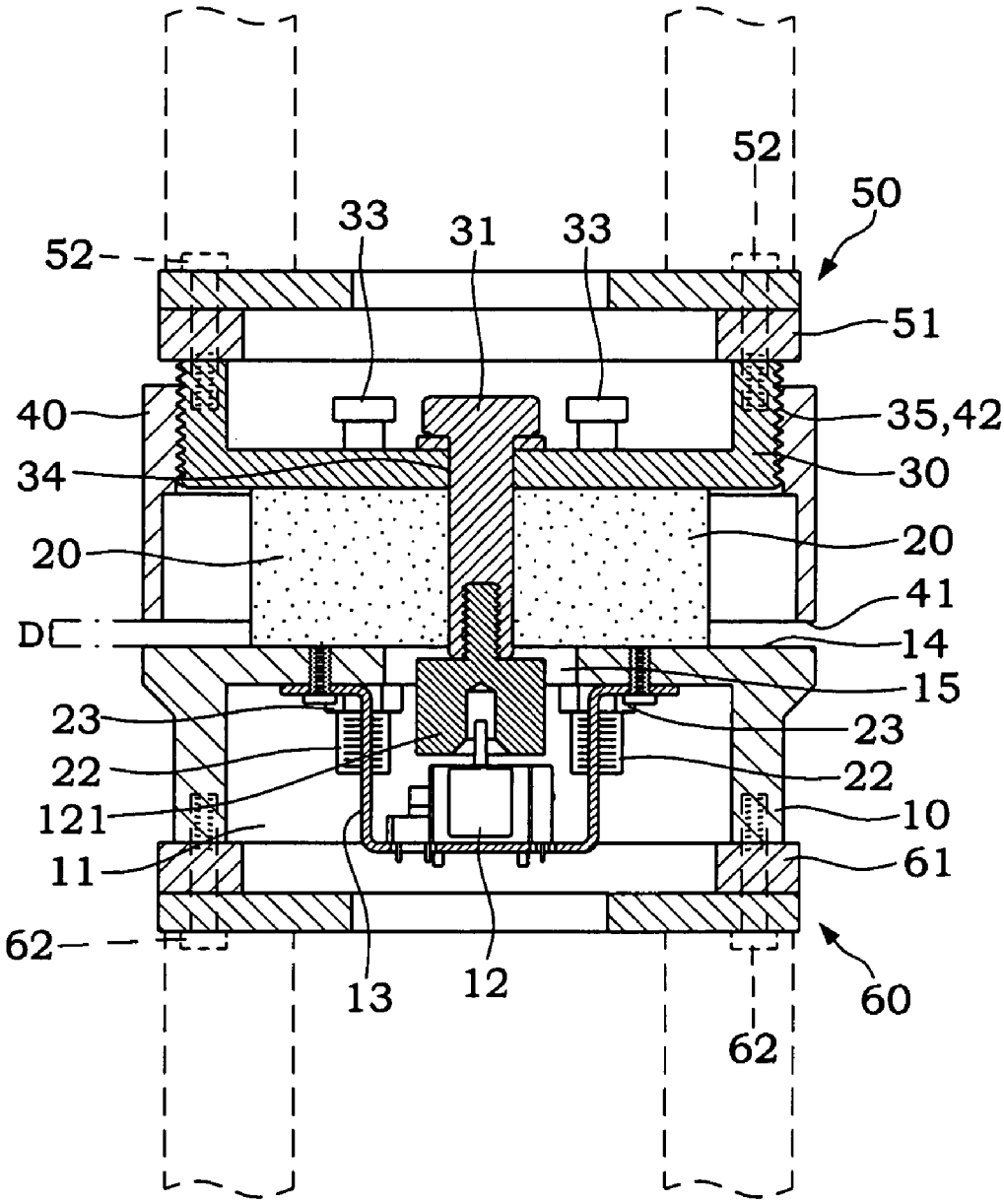
FIG. 5 corresponds to FIG. 3 but showing the distance between the control member and the head of the base shortened.
Figure 6:
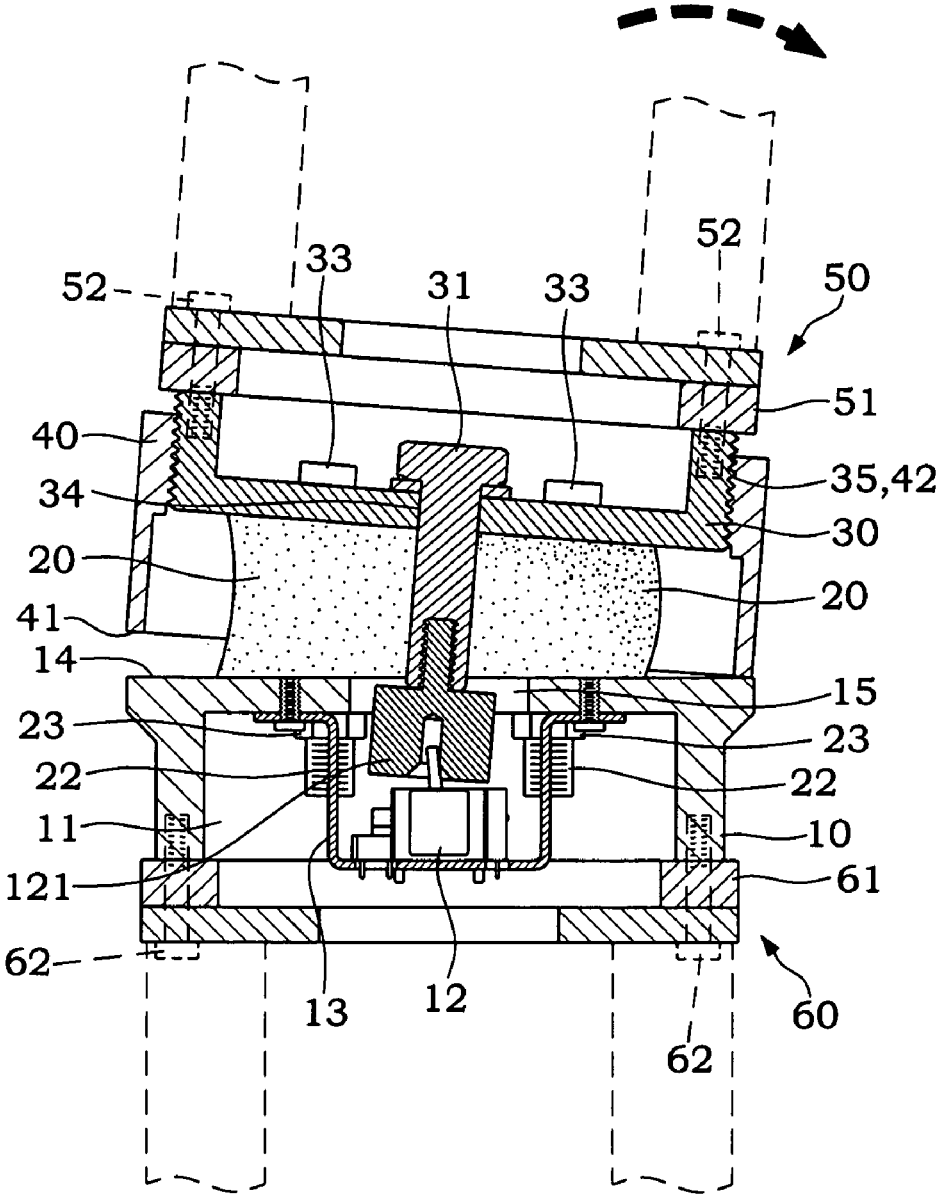
FIG. 6 is a schematic drawing corresponding to FIG. 5, showing the joystick tilted in one direction.
Figure 7:
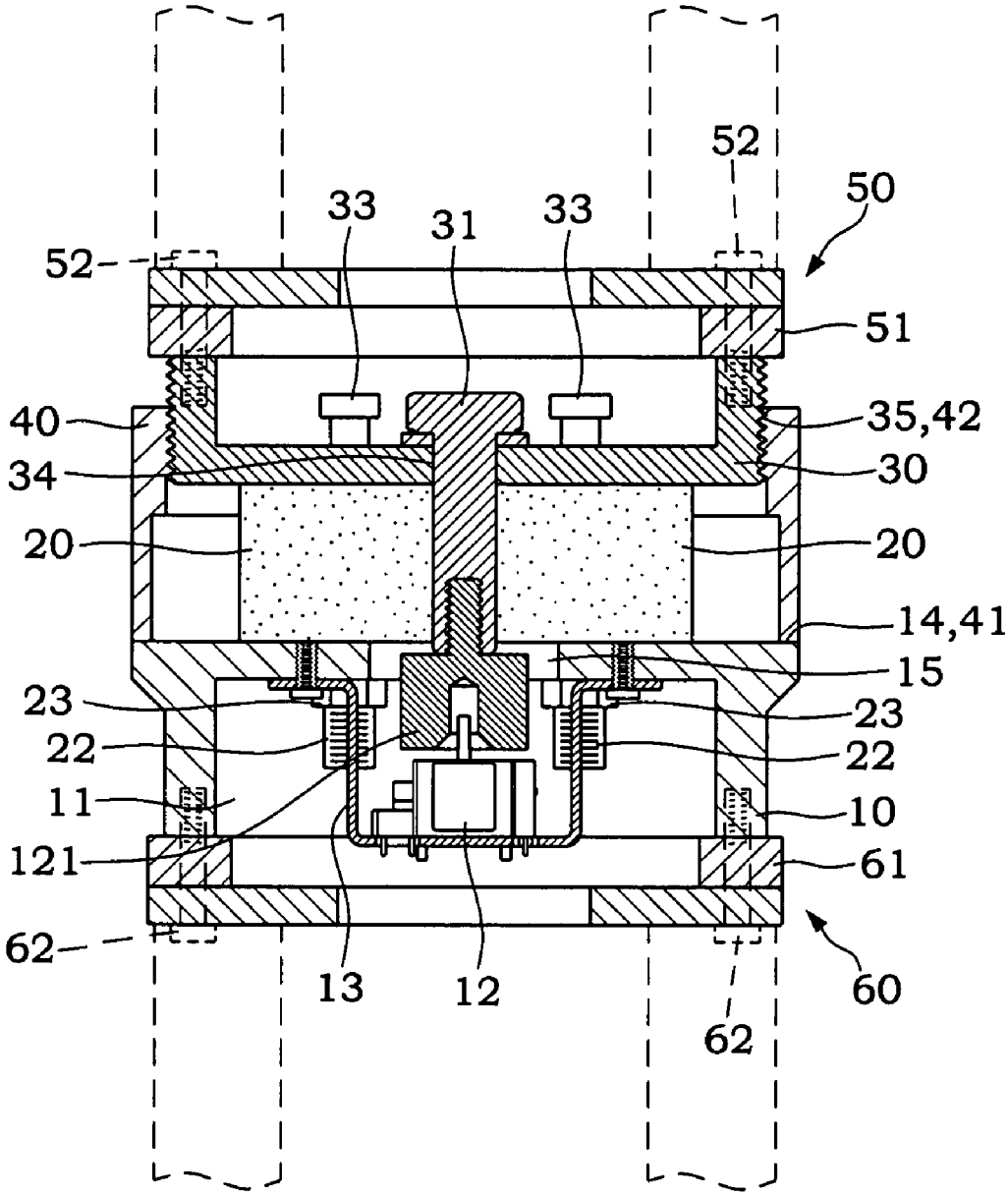
FIG. 7 is a sectional view of the present invention, showing the joystick locked.

By means of rotating the control member 40 relative to the motion member 30 to adjust the distance D between the bottom edge 41 of the control member 40 and the top side of the head 14 of the base 10, the maximum biasing angle of the motion member 30 relative to the base 10 is relatively adjusted. For example, the maximum biasing angle of the motion member 30 relative to the base 10 is relatively increased when increased the distance D between the bottom edge 41 of the control member 40 and the top side of the head 14 of the base 10 (see FIGS. 3 and 4). On the contrary, the maximum biasing angle of the motion member 30 relative to the base 10 is relatively reduced when shortened the distance D between the bottom edge 41 of the control member 40 and the top side of the head 14 of the base 10 (see FIGS. 5 and 6). When zeroed the distance D between the bottom edge 41 of the control member 40 and the top side of the head 14 of the base 10, the operating member 50 is stopped from biasing (see FIG. 7), and the joystick is prohibited from operation.

A prototype of joystick has been constructed with the features of FIGS. 1~7. The joystick functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A joystick comprising:

a base fixedly fastened to the body of a motion apparatus, said base having a top: a plurality of elastomeric members installed in the top of said base and equiangular spaced from one another, said elastomeric members each having a bottom side fastened to the top of said base and a top side;

a motion member fixedly to said elastomeric members and supported on the top side of each said elastomeric member and fixedly connected to an operating member for synchronous motion with said operating member relative to said base;

sensor means adapted to detect the direction and amount of movement of said motion member relative to said base and to output a signal indicative of the direction and amount of movement of said motion member;

a control member axially movably coupled to said motion member and turnable relative to said motion member to adjust the distance between the lowest edge of said control member and the top of said base so as to further control the range within which said motion member is biasable relative to said base; and wherein said elastomeric members are cylindrical rubber members, each having a bottom screw rod respectively inserted through a mounting through hole at the head of said base and screwed up with a nut inside said base.

2. A joystick comprising:

a base fixedly fastened to the body of a motion apparatus, said base having a top: a plurality of elastomeric members installed in the top of said base and equiangular spaced from one another, said elastomeric members each having a bottom side fastened to the top of said base and a top side;

a motion member fixedly to said elastomeric members and supported on the top side of each said elastomeric member and fixedly connected to an operating member for synchronous motion with said operating member relative to said base;

sensor means adapted to detect the direction and amount of movement of said motion member relative to said base and to output a signal indicative of the direction and amount of movement of said motion member;

a control member axially movably coupled to said motion member and turnable relative to said motion member to adjust the distance between the lowest edge of said control member and the top of said base so as to further control the range within which said motion member is biasable relative to said; and wherein said elastomeric members are cylindrical rubber members, and said motion member has a plurality of mounting through holes corresponding to said elastomeric members, with the said elastomeric members each having a top center screw hole connected to the mounting through holes of said motion member with a screw.

3. A joystick comprising:

a base fixedly fastened to the body of a motion apparatus, said base having a top: a plurality of elastomeric members installed in the top of said base and equiangular spaced from one another, said elastomeric members each having a bottom side fastened to the top of said base and a top side;

a motion member fixedly to said elastomeric members and supported on the top side of each said elastomeric member and fixedly connected to an operating member for synchronous motion with said operating member relative to said base;

sensor means adapted to detect the direction and amount of movement of said motion member relative to said base and to output a signal indicative of the direction and amount of movement of said motion member;

a control member axially movably coupled to said motion member and turnable relative to said motion member to adjust the distance between the lowest edge of said control member and the top of said base so as to further control the range within which said motion member is biasable relative to said base; and wherein said control member is fastened to said motion member through a screw joint.

4. The joystick as claimed in claim 3, wherein said screw joint comprises an outer thread extending around the periphery of said motion member, and an inner thread fixedly provided inside said control member and threaded onto said outer thread.

5. A joystick comprising:

a base fixedly fastened to the body of a motion apparatus, said base having a top: a plurality of elastomeric members installed in the top of said base and equiangular spaced from one another, said elastomeric members each having a bottom side fastened to the top of said base and a top side;

a motion member fixedly to said elastomeric members and supported on the top side of each said elastomeric member and fixedly connected to an operating member for synchronous motion with said operating member relative to said base;

sensor means adapted to detect the direction and amount of movement of said motion member relative to said base and to output a signal indicative of the direction and amount of movement of said motion member;

a control member axially movably coupled to said motion member and turnable relative to said motion member to adjust the distance between the lowest edge of said control member and the top of said base so as to further control the range within which said motion member is biasable relative to said base; and wherein said control member is movable relative to said motion member to the position where the lowest edge of said control member touches the top of said base and said motion member is stopped from motion relative to said base.

6. A joystick comprising:

a base fixedly fastened to the body of a motion apparatus, said base having a top: a plurality of elastomeric members installed in the top of said base and equiangular spaced from one another, said elastomeric members each having a bottom side fastened to the top of said base and a top side;

a motion member fixedly to said elastomeric members and supported on the top side of each said elastomeric member and fixedly connected to an operating member for synchronous motion with said operating member relative to said base;

sensor means adapted to detect the direction and amount of movement of said motion member relative to said base and to output a signal indicative of the direction and amount of movement of said motion member;

a control member axially movably coupled to said motion member and turnable relative to said motion member to adjust the distance between the lowest edge of said control member and the top of said base so as to further control the range within which said motion member is biasable relative to said base; and wherein the joystick is prohibited from motion when the distance between said control member and the top of said base is zeroed.

* * * * *